United States Patent [19]

Durenec

[11] 4,092,833

[45] June 6, 1978

[54] SPLIT-PHASE COOLER WITH EXPANSION PISTON MOTION ENHANCER

[75] Inventor: Peter Durenec, Annandale, Va.

[73] Assignee: The United States of America as represented by the Secretary of the Army, Washington, D.C.

[21] Appl. No.: 773,033

[22] Filed: Feb. 28, 1977

[51] Int. Cl.[2] ..... F25B 9/00

[52] U.S. Cl. ..... 62/6

[58] Field of Search ..... 62/6

[56] References Cited

U.S. PATENT DOCUMENTS

| | | | |
|---|---|---|---|
| 3,423,948 | 1/1969 | Cowans | 62/6 |
| 3,472,037 | 10/1969 | Kohler et al. | 62/6 |
| 3,933,000 | 1/1976 | Doody | 62/6 |
| 4,036,027 | 7/1977 | Bamberg | 62/6 |

*Primary Examiner*—Lloyd L. King

*Attorney, Agent, or Firm*—Nathan Edelberg; Aubrey J. Dunn; Robert P. Gibson

[57] ABSTRACT

A Stirling-cycle refrigerator including a compressor portion having two cylinders with respective pistons therein, and an expansion portion with a cylinder having first and second distinct spaces and with opposite ends of an expansion piston in the distance spaces. The two cylinders of the compressor portion are connected by respective conduits to the two spaces of the expansion portion. The end of the expansion piston in the first space has a regenerator therein. The two pistons of the compressor are driven 180° out of phase, whereby to simultaneously induce compression in the first expansion portion space and expansion in the second through respective conduits.

3 Claims, 2 Drawing Figures

SPLIT-PHASE COOLER WITH EXPANSION PISTON MOTION ENHANCER

The invention described herein may be manufactured, used, and licensed by the U.S. Government for governmental purposes without the payment of any royalties therein.

BACKGROUND OF THE INVENTION

This invention is in the field of split-cycle Stirling-cycle coolers which generally have a compression portion and expansion portion connected by a refrigerant conduit. The expansion portion has a "cold finger" in which expansion of the refrigerant occurs. This cold finger has an ambient end from which the refrigerant towards a cold end. Thus a temperature gradient will exist from the ambient to the cold end of the finger. Typical of such coolers are those shown in the U.S. Pat. Nos. 3,630,041, 3,862,546 and 3,877,239. An improvement in operation of such typical coolers will be realized if the temperature gradient along the cold finger is reduced. The present invention is able to reduce this gradient by providing enhancing motion of the expansion piston.

SUMMARY OF THE INVENTION

The invention is an improved Stirling-cycle cooler of the split cycle type wherein expansion piston motion enhancement is used for better cooling. The cooler employs a first compressor piston and cylinder connected by a refrigerant conduit to a first expansion space. This expansion space has one end of an expansion piston therein, with a regenerator inside said one end. The motion enhancer employs a second compressor piston and cylinder connected by a refrigerant conduit to a second expansion space. This second expansion space has the other end of said expansion piston therein. The two compressor pistons are driven from a common motor, but at a 180° phase difference. This phase difference insures that one end of the expansion piston is under suction while the other end is under compression, and conversely.

DETAILED DESCRIPTION OF THE INVENTION

Figure 1:
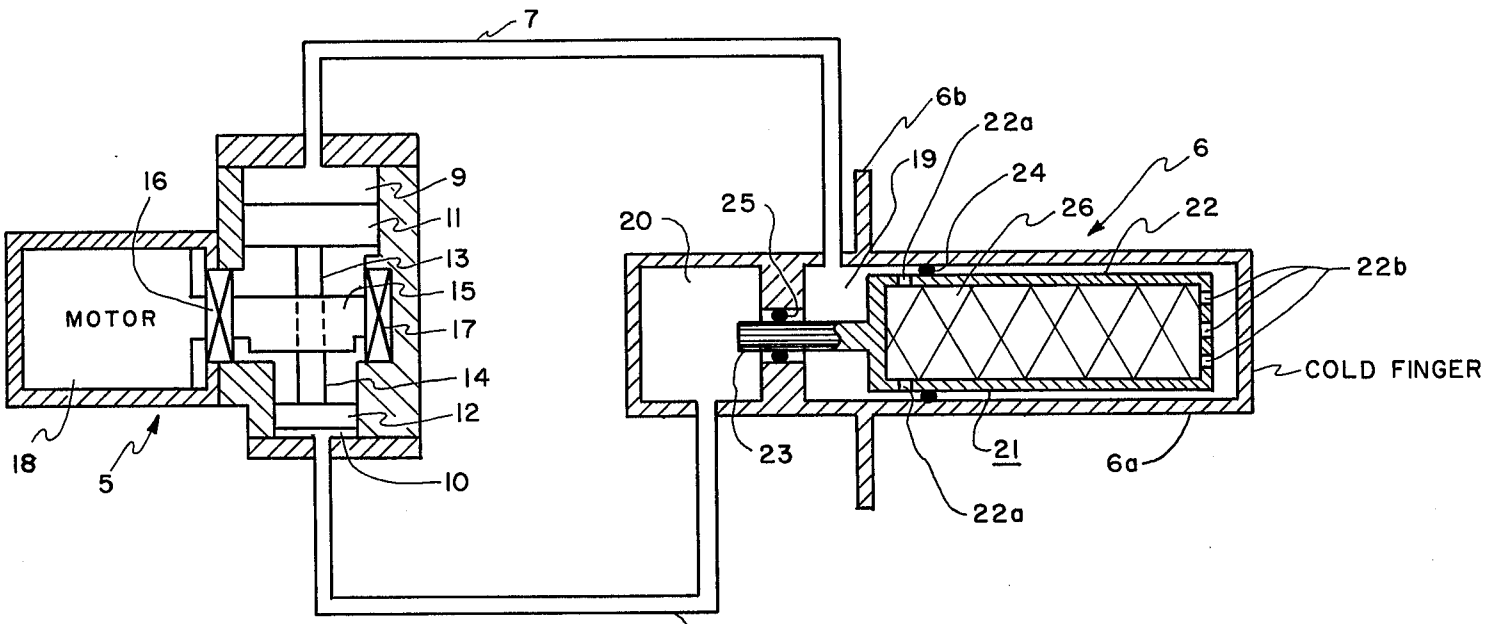
FIG. 1 shows a diagramatic view of one embodiment of the invention.

The invention may perhaps be best understood by referring to the drawings, in which the embodiment of FIG. 1 includes compressor portion 5, expansion portion 6, and refrigerant conduits 7 and 8. Portion 5 includes first and second cylinders 9 and 10 with respective pistons 11 and 12 therein. Pistons 11 and 12 are connected by arms 13 and 14 to crankshaft 15 supported by bearings 16 and 17. Motor 18 turns crankshaft 15. Rods 13 and 14 are mounted to crankshaft 15 such that pistons 11 and 12 move in the same direction as 15 rotates. This gives a 180° phase difference in the compression-expansion cycles in cylinders 9 and 10. I.e., the refrigerant in cylinder 9 is undergoing compresion at the same time that refrigerant in cylinder 20 is being expanded, and conversely. Conduits 7 and 8 respectively connect cyliners 9 and 10 to spaces 19 and 20 in expansion portion 6. This expansion portion includes housing *6a* with flange *6b* and an expansion piston 21 respectively having end 22 and smaller end 23 in respective spaces 19 and 20. Piston 21 is supported by and sealed in housing *6a* by 0-rings 24 and 25 (or equivalent) fixed in housing *6a*. The rings may be seated in grooves (not shown) in *6a* or otherwise held stationary therein. As can be seen in the drawings, end 22 of piston 21 is hollow, with openings *22a* and *22b* communicating with the interior space of 21. This interior space is filled with material 26 which acts as a regenerator, in the usual manner.

Figure 2:
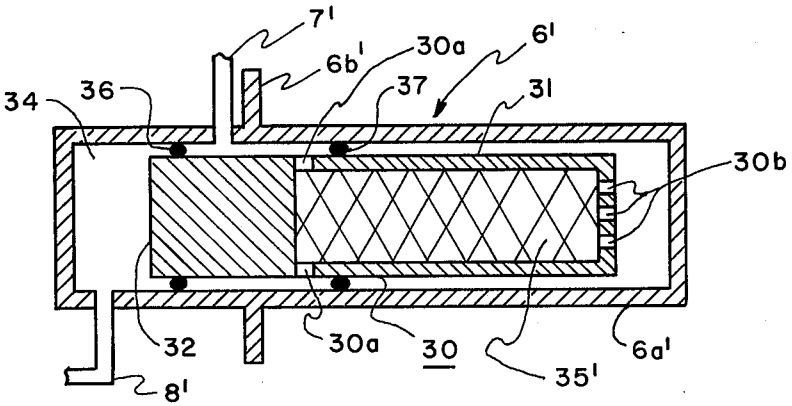
FIG. 2 shows a diagramatic view of a second embodiment of the invention.

The alternate embodiment of FIG. 2 is similar in its compressor portion and conduits to the FIG. 1 embodiment and only expansion portion 6' is shown in detail. Conduits 7' and 8' correspond to respective conduits 7 and 8 of FIG. 1. Portion 6' includes housing *6a'*, flange *6b'*, and piston 30 in housing *6a'*. Piston 30 has ends 31 and 32 in respective spaces 33 and 34. Piston 30 is hollow and has openings *30a* and *30b* communicating with its interior. Within this interior is regenerator 35, corresponding to regenerator 26 of FIG. 1. Piston 30 is supported by and sealed in housing *6a'* by 0-rings 36 and 37 or equivalent fixed to the interior walls of *6a'* or in grooves (not shown) in *6a'*.

OPERATION OF INVENTION

Expansion portions 6 and 6' of drawings are the cooling portions of the invention, with the right end of housings *6a* and *6a'* being the "cold finger" parts. These housings are inserted in the regions to be cooled, with their flanges (*6b* or *6b'*) seated against a wall of the cooled region. The flanges are thus at the ambient zones of the coolers. It is assumed that the cooler(s) contain a proper refrigerant. In FIG. 1, upward movement of the pistons allows the refrigerant to be compressed by piston 11 in cylinder 9, to pass through conduit 7 and to expand through regenerator 26 in space 19. Cylinder 21 tends to move to the left. Thus, a stage of cooling is provided. At the same time, piston 12 moves to provide expansion of fluid (refrigerant) in cylinder 10, and thus produces a suction in space 20. This suction acts on end 23 of cylinder 21 and enhances the leftward movement of cylinder 21. When pistons 11 and 12 move in the opposite direction, fluid is compressed in cylinder 10, passes through conduit 8 and expands in space 20. Piston 11 at the same time is inducing a suction in cylinder 9, conduit 7 and space 19, and piston 21 tends to move to the right. This tendency is enhanced by the expansion of fluid in space 20 against end 23 of piston 21. Operation of the FIG. 2 embodiment is similar to the operation of the FIG. 1 embodiment, except that an optimized operation of the invention can be achieved with end 32 of piston 30 having the same diameter as the rest of the piston.

I claim:

1. A split-cycle mechanical cooler having a compression portion, a distinct expansion portion, and conduit means between said portions: said compression portion including a first piston in a first cylinder and a second piston in a second cylinder, and means for reciprocally moving said pistons in said cylinders in phase opposition; said expansion portion including a third cylinder having distinct first and second spaces, a third piston in said third cylinder having opposite ends respectively in said first and second spaces, and a regenerator in said end of said third cylinder which is in said first space of said third cylinder; and said conduit means including first and second conduits respectively connecting said first cylinder to said first space and said second cylinder to said second space.

2. The cooler as defined in claim 1 wherein said ends of said third piston are of the same area.

3. The cooler as defined in claim 2 wherein said first and second cylinders and pistons are of different diameters.

* * * * *